US005709197A

United States Patent [19]

Oshidari et al.

[11] Patent Number: 5,709,197

[45] Date of Patent: Jan. 20, 1998

[54] FUEL PUMP

[75] Inventors: Toshikazu Oshidari, Yokosuka; Atsuhiro Sakamoto, Zushi; Shigeru Kamegaya, Tokyo; Iwane Inokuchi, Yokohama, all of Japan

[73] Assignee: Nissan Motor Co., Ltd., Kanagawa, Japan

[21] Appl. No.: 701,057

[22] Filed: Aug. 21, 1996

[30] Foreign Application Priority Data

Aug. 30, 1995 [JP] Japan ..... 7-221515

[51] Int. Cl.[6] ..... F02M 25/00; F04B 27/08; F04B 25/02

[52] U.S. Cl. ..... 123/679; 123/514; 123/690; 123/198 D; 417/269; 417/473

[58] Field of Search ..... 123/514, 508, 123/679, 690, 198 D; 417/269, 472, 473

[56] References Cited

U.S. PATENT DOCUMENTS 5,058,845 10/1991 Cardillo ..... 91/485
5,070,847 12/1991 Akiyama et al. ..... 123/489
5,283,548 2/1994 Kanno ..... 340/439
5,354,181 10/1994 Porel ..... 417/269
5,411,007 5/1995 Narita ..... 123/690
5,441,026 8/1995 Akimoto ..... 123/198 D

FOREIGN PATENT DOCUMENTS 2-7385 1/1990 Japan .
4-191461 7/1992 Japan .

*Primary Examiner*—Willis R. Wolfe
*Assistant Examiner*—Hieu T. Vo
*Attorney, Agent, or Firm*—Lowe, Price, LeBlanc & Becker

[57] ABSTRACT

Fuel is pressurized by the expansion and contraction of a pump chamber defined inside a casing according to the rotation of a power input shaft which penetrates from the outside of the casing into its inside. A first seal member is provided between the casing and the power input shaft and prevents escape of fuel which is inside the casing, and a second seal member is provided in series therewith. Further, leakage of fuel to the outside of the casing from the second seal member is prevented by the provision of a drain conduit which drains fuel which has leaked into a space defined between the first seal member and the second seal member.

4 Claims, 10 Drawing Sheets

FUEL PUMP

FIELD OF THE INVENTION

This invention relates to a fuel pump which is used for fuel supply to an engine or the like, and more particularly relates to a construction for preventing leakage of fuel from such a fuel pump.

BACKGROUND OF THE INVENTION

With an fuel injection type internal combustion engine which employs fuel injectors, it is necessary to keep the fuel injection pressure high, not only to promote the atomization of fuel into fine particles, but also in order to prevent the occurrence of vaporization in the fuel conduits. It is possible to obtain this sort of high pressure easily by the use of a plunger type fuel injection pump, for example.

However, when a plunger type pump in which a plunger executes sliding motion in a cylinder is used for pumping gasoline, the viscosity of which is relatively low, the fuel can easily leak through the gap which is necessarily left between the plunger and the cylinder in order to allow this sliding motion, and there is a tendency for the loss of pump driving torque to become relatively high.

For this reason there has been proposed, for example in Tokkai Hei 4-191461 published by the Japanese Patent Office in 1992, a fuel injection pump which prevents leakage of fuel by providing the pump chamber which performs the compression of fuel with a bellows which can expand and contract freely.

In this pump, a plurality of pump chambers which are provided with bellows are arranged on a straight line so that the central axes of the pump chambers are parallel to one another. A cam shaft is provided at one end of the bellows, and a cam fixed on the cam shaft expands and contracts the bellows according to the rotation of the cam shaft. After the fuel has been pressurized to a low pressure by a feed pump which is provided separately, it is sucked into this fuel injection pump, and is supplied to the engine after being compressed by the fuel injection pump.

Further, Tokkai Hei 2-7385 published by the Japanese Patent Office in 1990 discloses a bellows pump which has a plurality of pump chambers which are provided with bellows and are arranged in a circle so that the central axes of the pump chambers are parallel to one another.

With these bellows pumps, if the bellows is damaged, the fuel which is pressurized by the feed pump will gush out into the interior of the casing, and will leak out to the outside from the seal between the drive shaft and the casing.

It is possible to reduce the output pressure of the feed pump, but, even if this is done there is a problem with regard to preventing the leaking out of fuel even if for example a pressure resistant seal is used, since engine fuel such as gasoline or the like generally has a low viscosity.

SUMMARY OF THE INVENTION

It is therefore an object of this invention to prevent leakage of fuel from the pump casing of a pump which supplies pressurized fuel to an engine.

It is a further object of this invention promptly to detect leakage of fuel from such a fuel pump and to issue a warning thereof.

In order to achieve the above objects, this invention provides a fuel pump for supplying pressurized fuel to an engine. This fuel pump comprises a casing, a pump chamber defined inside the casing, a power input shaft which penetrates from the outside of the casing into the inside of the casing, a mechanism for expanding and contracting the pump chamber according to the rotation of the power input shaft, a first seal member which is provided between the casing and the power input shaft, a second seal member which is provided in series with the first seal member between the casing and the power input shaft, and a drain conduit which drains fuel which has leaked into a space defined between the first seal member and the second seal member.

If the engine comprises an intake port for aspirating air, it is preferable that the drain conduit communicates with the intake port.

It is also preferable that the fuel pump further comprises a mechanism for detecting fuel flow in the drain conduit and a mechanism for emitting a warning when fuel is flowing in the drain conduit.

If the engine further comprises an exhaust conduit for expelling exhaust, an $O_2$ sensor displaced in the exhaust conduit, and a mechanism for feedback controlling an air/fuel ratio of an air-fuel mixture provided to the engine to a target value based upon a feedback control amount which corresponds to the output of the $O_2$ sensor, it is preferable that the detecting mechanism comprises a mechanism for detecting fuel flow in the drain conduit from the feedback control amount.

If the engine comprises a fuel tank in which fuel is stored, the drain conduit may communicate to the fuel tank.

In this case, it is preferable that the fuel pump further comprises a check valve provided part way along the drain conduit which is opened when subjected to a predetermined opening pressure, a pressure switch provided upstream of the check valve in the drain conduit which turns on when subjected to a pressure lower than the opening pressure, a mechanism for detecting fuel flow in the drain conduit based upon the turning on of the pressure switch, and a mechanism for emitting a warning when fuel is flowing in the drain conduit.

The details as well as other features and advantages of this invention are set forth in the remainder of the specification and are shown in the accompanying drawings.

DESCRIPTION OF THE PREFERRED EMBODIMENTS

Figure 1:
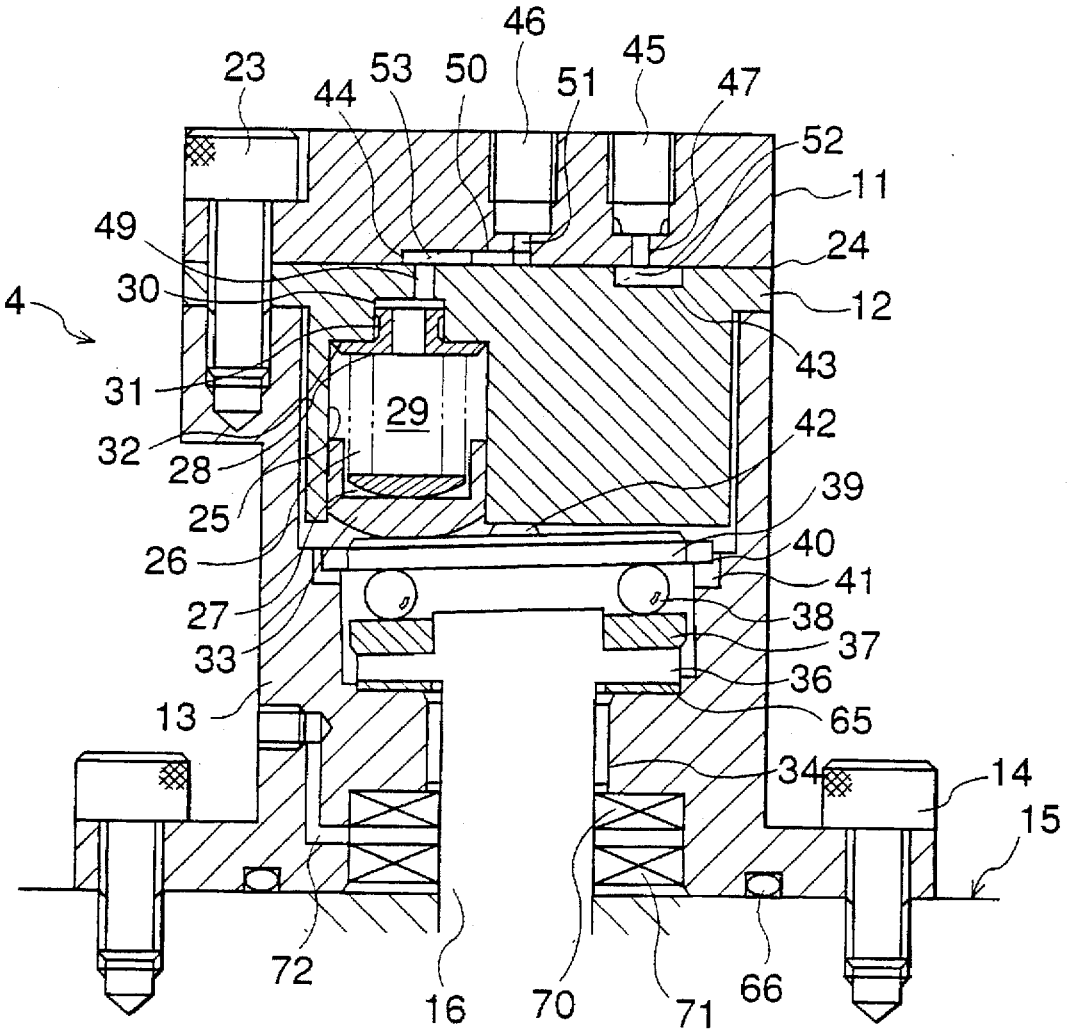
FIG. 1 is a longitudinal sectional view of a fuel pump according to a first preferred embodiment of this invention.

Referring to FIG. 1 of the drawings, in a fuel injection pump 4 the rotation of a power input shaft 16 expands and contracts a bellows 26 via a swashplate 39, and thereby fuel is sucked through an intake port 45 into a pressure chamber 29 on the inside of the bellows 26, is pressurized, and is expelled through an output port 46.

Figure 7:
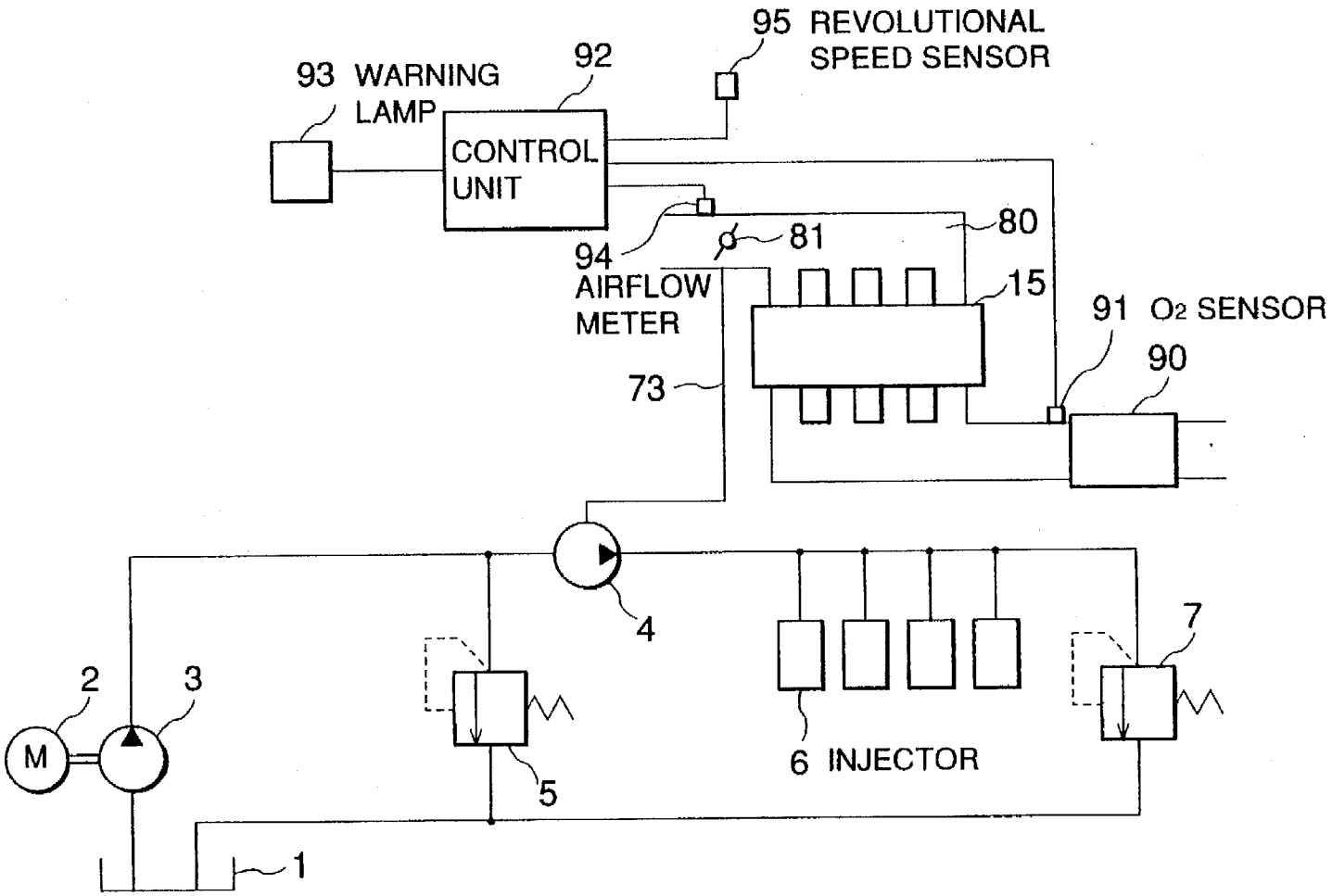
FIG. 7 is a schematic diagram of a fuel injection system according to the first preferred embodiment of this invention.

This fuel injection pump 4 is applied to a fuel injection system for an automobile engine, as shown in FIG. 7. In this system, a feed pump 3 which is driven by an electric motor 2 supplies fuel from a fuel tank 1 to the intake port 45 of the fuel injection pump 4. The pressure at which this fuel is supplied is kept almost constant by a low pressure regulator valve 5. Fuel which has been pressurized by the fuel injection pump 4 is conducted from the output port 46 thereof to the injectors 6 via high pressure conduits. The output pressure of the fuel injection pump 4 is kept almost constant by a high pressure regulator 7.

Figure 8:
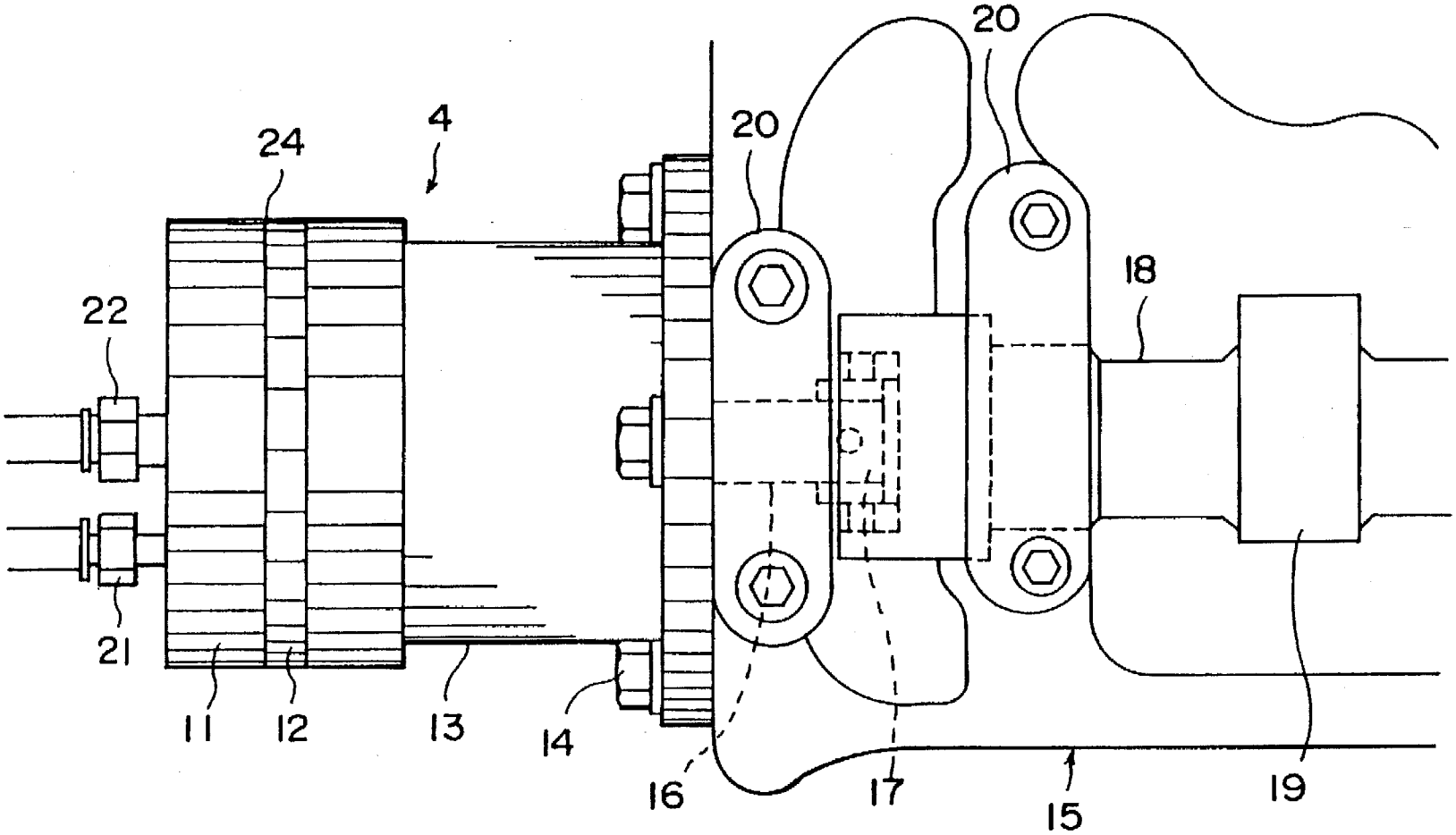
FIG. 8 is a plan view of the fuel pump fitted to a cylinder head of an engine.

This fuel injection pump 4 comprises a pump head 11, a cylinder block 12, and a casing 13, as shown in FIG. 8, is fixed by bolts 14 to the cylinder head 15 of the engine. An O ring 66 is provided between the mutually contacting faces of the casing 13 and the cylinder head 15.

The power input shaft 16 of this fuel injection pump 4 is connected to an intake valve cam shaft 18 of the engine via a joint 17. This intake valve cam shaft 18 is supported within the cylinder head 15 by brackets 20. The intake valve cam shaft 18 rotates in synchronous with the rotation of the crank shaft (not shown in the figures) of the engine, and opens and closes intake valves (not shown either) via cams 19, as well as rotating the power input shaft 16.

Joints 21 and 22 are fitted to the pump head 11 of the fuel injection pump 4 and connect conduits to its intake port 45 and to its output port 46.

Figure 6:
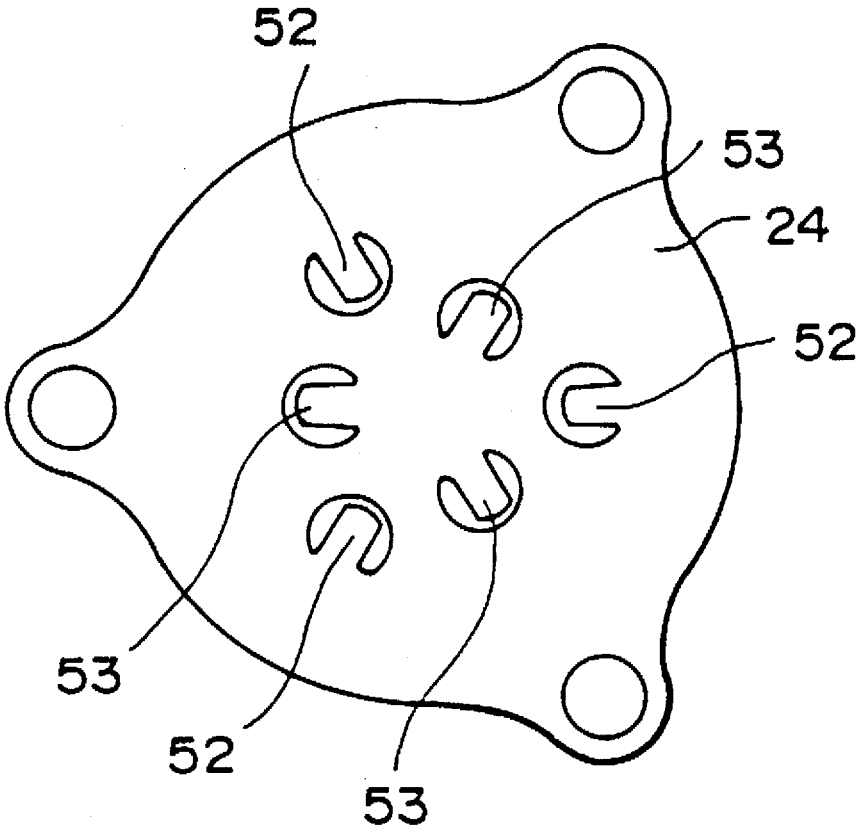
FIG. 6 is a plan view of a reed valve plate fitted in the fuel pump.

The pump head 11, the cylinder block 12, and the casing 13 are connected together by bolts 23, as shown in FIG. 1. A reed plate 24 in which three inlet reed valves 52 and three outlet reed valves 53 are formed as shown in FIG. 6 is interposed between the pump head 11 and the cylinder block 12.

Three cylinders 25 are formed in the cylinder block 12 around its central axis. Each of these cylinders 25 opens to the end surface of the cylinder block 12 which contacts the casing 13. Each of the bellows 26 is formed in a round tubular shape and is fitted inside its cylinder 25.

A part spherical end cap 27 is fixed by welding to one end of the bellows 26 which corresponds to its lower end in FIG. 1. This end portion is inserted into the inside of a piston 33 which is formed as a tubular cylinder, and contacts the bottom surface portion of the piston 33. The piston 33 is fitted into the inside of the cylinder 25 so as to be free to slide therein. The end portion of the piston 33 which faces in the downward direction in FIG. 1 is formed with a part spherical surface. A certain gap is provided between the outer periphery of the end cap 27 and the inner periphery of the bottom surface portion of the piston 33.

A flange 28 is welded to the other end of the bellows 26, i.e. to its end which corresponds to its upper end in FIG. 1. The pressure chamber 29 is defined by the bellows 26, the end cap 27, and the flange 28.

The flange 28 comprises a boss 30. This boss 30 is fitted into a recess formed at a region of the cylinder 25 which corresponds to its upper end in FIG. 1. An O ring 31 is fitted upon the outer periphery of the boss 30 for preventing leakage of fuel from the pressure chamber 29.

The outer diameter of the boss 30 is made smaller than the effective diameter of the bellows 26. The pressure in the pressure chamber 29 acts both upwards and also downwards upon the flange 28, but, since the outer diameter of the pressure receiving boss 30 is made smaller than the effective diameter of the bellows 26, therefore the pressure receiving area on the downward facing side is larger. Accordingly, the pressure in the pressure chamber 29 acts in the upwards direction upon the flange 28. The flange 28 is kept at the upper end of the cylinder 25 by this force and by the elastic extension force of the bellows 26 itself. Moreover, the pressure present in the pressure chamber 29 is always higher than a certain predetermined constant pressure, since the feed pump 3 is always working when the engine is running.

The outer radius of the flange 28 is set greater than the outer radius of the bellows 26, and as a result the extending portion 32 of the flange 28 is outside the bellows 26.

The casing 13 coaxially supports the power input shaft 16 via a metal bush 34. A flange portion 36 is formed at the end of the power input shaft 16. The thickness in the axial direction of this flange portion 36 is different at different regions thereof, and its lower surface in the figure lies wholly in a plane perpendicular to the central axis of the power input shaft 16 and is supported from the casing 13 by a thrust washer 65. On the other hand, its upper surface in the figure is formed as sloping upwards and downwards.

This sloping upper face of the flange portion 36 supports a thrust bearing which is composed of a plate 37, balls 38, and a swashplate 39. The plate 37 is formed in a circular shape and is fixed to the flange portion 36 and rotates together with the power input shaft 16. The swashplate 39 is formed in a circular shape, and a part spherical projection 42 formed at its center is contacted against the cylinder block 12. Further, the part spherical end surfaces of the three pistons 33 are contacted against this swashplate 39. The balls 38 are sandwiched between the plate 37 and the swashplate 39.

Projections 40 which extend in the radial direction are formed in two places upon the outer peripheral surface of the swashplate 39. The rotation of the swashplate 39 is prevented by these projections 40 being engaged with grooves 41 which are formed in the casing 13. Accordingly, when the plate 37 which is formed as sloping rotates, the balls 38 rotate above this plate 37, while the swashplate 39 does not rotate, and instead executes a nutating gyration about the projection 42 as a center.

Fuel fills the casing 13 as lubricant for the various sliding members. Oil seals 70 and 71 are provided between the power input shaft 16 and the casing 13. These oils seals 70 and 71 are fixed in the casing 13 in series along the shaft 16 with a certain gap being left between them and both slide against the shaft 16.

It is preferable that the oil seal 70 should be made from some substance of excellent durability, so that sudden leakage should not occur even if it is subjected to the output pressure of the feed pump 3 on the inside of the casing 13.

Further, preferably, processing traces are cut in the form of spirals are made in the periphery of the power input shaft 16, and when the power input shaft 16 is rotated, these processing traces act as a spiral pump. In other words, these traces exert a propulsion force towards the inside of the casing 13 beyond the seal 70 upon fuel in the space between the oil seals 70 and 71. By doing this, leakage of lubricant from the oil seal 70 is prevented, if the pressure of the lubricant within the casing 13 has increased due to elevation of the temperature.

A space is defined between the oil seals 70 and 71 and by the outer peripheral surface of the power input shaft 16 and the wall surface of the casing 13, and this space is communicated with a escape conduit 72 formed in the casing 13. This escape conduit 72 opens to the outer surface of the casing 13, and a escape conduit 73 is connected to this opening, as schematically shown in FIG. 7. This escape conduit 73 is connected to an intake passage 80 of the engine directly downstream of a throttle valve 81.

Figure 4:
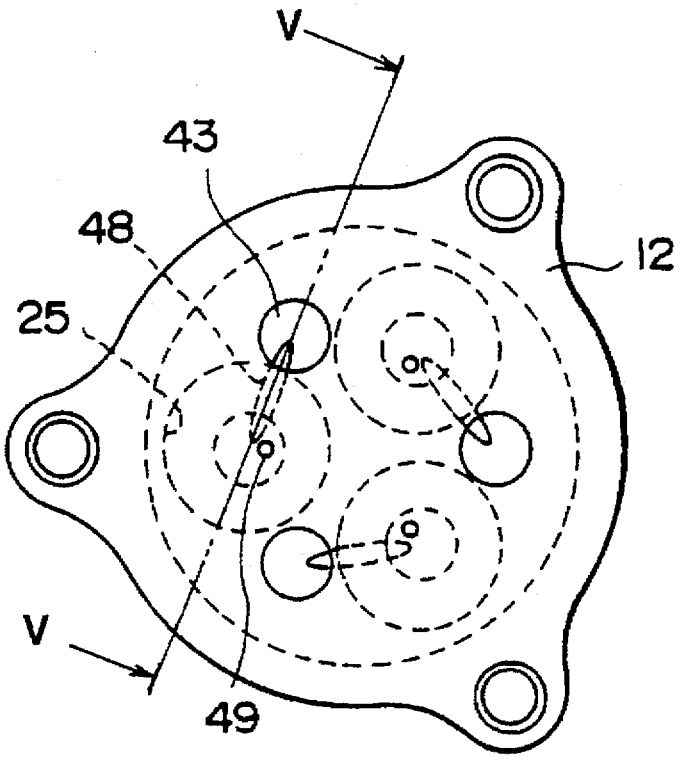
FIG. 4 is a plan view of a cylinder block of the fuel pump as seen from the side of the pump head.
Figure 5:
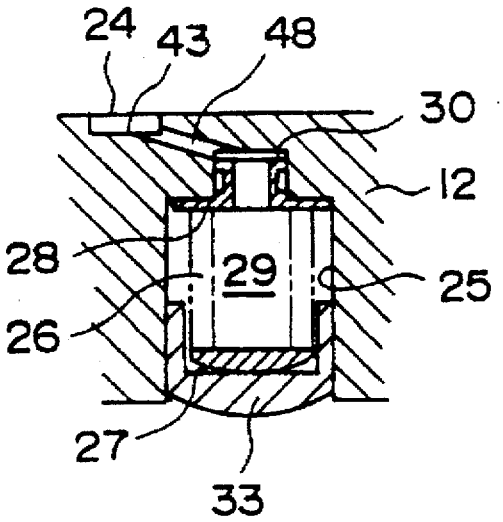
FIG. 5 is a sectional view of a portion of the pump head taken in a plane shown by the line V—V in FIG. 4.

Concave portions 43 for the operation of the three inlet reed valves 52 shown in FIG. 6 are formed in the surface of the cylinder block 12 which contacts the pump head 11 at three places positioned between the three cylinders 25, as shown in FIG. 4. Each concave portions 43 is communicated to the pressure chamber 29 via a space on the inside of the boss 30 of the flange 28 and via a conduit 48 which is formed in the cylinder block 12, as shown in FIG. 5.

Figure 2:
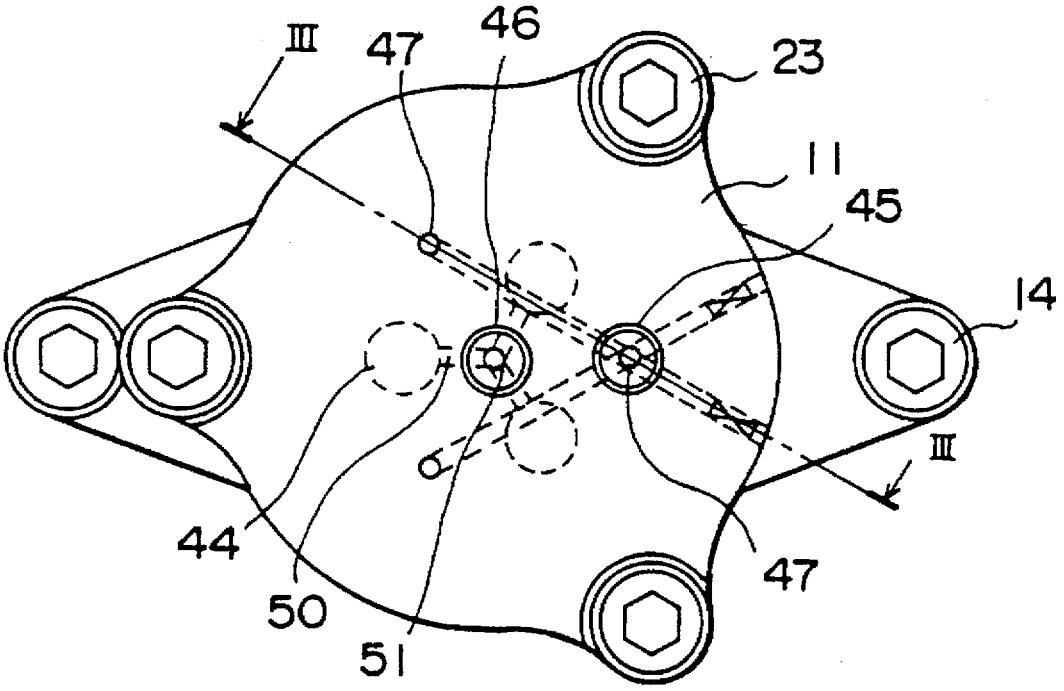
FIG. 2 is a plan view showing the fuel pump as seen from the side of a pump head.
Figure 3:
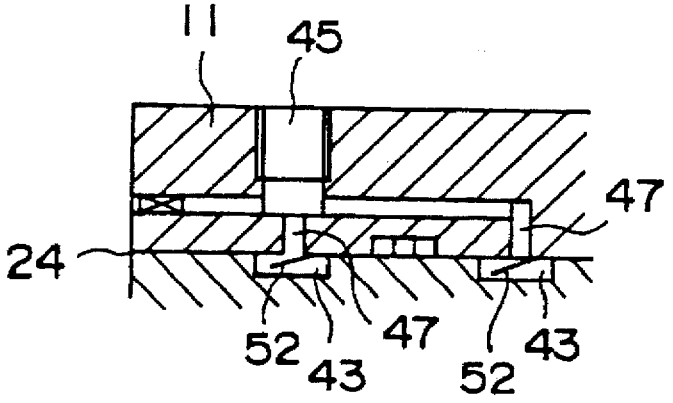
FIG. 3 is a sectional view of a portion of the fuel pump taken in a plane shown by the line III—III in FIG. 2.

On the other hand, oil conduits 47 which communicate the intake port 45 with the three concave portions 43 are formed in the pump head 11, as shown in FIGS. 2 and 3. Each oil conduit 47 is connected to the concave portions 43 of the cylinder block 12 via the inlet reed valves 52 as shown in FIG. 3, so that the inlet reed valves 52 are opened when the pressure in the pressure chamber 29 is lower than that at the intake port 45, while they are closed when this pressure in the pressure chamber 29 is higher than the pressure at the intake port 45.

Further, concave portions 44 for the operation of the three outlet reed valves 53 are formed in the surface of the pump head 11 which contacts the cylinder block 12 at three places positioned between the three cylinders 25. These concave portions 44 are communicated with the output port 46 via a groove 50 which is formed in the above contacting face, and via an oil conduit 51 which is formed on the inside of the pump head 11.

Three conduits 49 are formed in the cylinder block 12 which communicate to the pressure chambers 29 via the space within the boss 30. Each of these conduits 49 is communicated to one of the concave portions 44 via one of the outlet reed valves 53 as shown in FIG. 1. The outlet reed valves 53 are opened when the pressure in the pressure chamber 29 is higher than that at the output port 46, while they are closed when this pressure in the pressure chamber 29 is lower than the pressure at the output port 46.

Each of the inlet reed valves 52 and the outlet reed valves 53 is formed by providing a horseshoe shaped cutout in a reed plate 24. As shown in FIG. 6, the inlet reed valves 52 and the outlet reed valves 53 are arranged alternately, and this makes it possible for the fuel injection pump 4 to be constructed with a relatively small diameter.

When the power input shaft 16 rotates in synchronous with the rotation of the crank shaft of the engine, the plate 37 which is fixed to the power input shaft 16 in a sloping orientation also is rotated. On the other hand, since the rotation of the swashplate 39 is prevented by the projections 40, the balls 38 are rotated by the mutual relative rotation between the plate 37 and the swashplate 39. The plate 37 which is rotating in a sloping orientation drives the swashplate 39 in a nutating manner about the part spherical projection 42 as a central support point so as to displace the points upon its periphery to and fro in the axial direction. Along with this, the pistons 33 whose ends are in contact with the swashplate 39 are driven to and fro along their axial directions, and the bellows 26 are expanded and contracted.

In this connection, when the swashplate 39 is displaced in the direction to be separated from the end of any one of the pistons 33, the volume of the corresponding pressure chamber 29 is increased due to the elastic force of the corresponding bellows 26, and thereby the pressure in this pressure chamber 29 is reduced. Along with this, the fuel flows into the pressure chamber from the intake port 45 via the oil conduit 47, the inlet reed valve 52, and the oil conduit 48. At this time, the outlet reed valve 53 remains closed.

Further, when the swashplate 39 presses upon the piston 33 and forces it into its cylinder 25, the bellows 26 is compressed, and the pressure in the pressure chamber 29 rises. Along with this, the fuel in the pressure chamber 29 is expelled from the output port 46 via the oil conduit 49, the outlet reed valve 53, the groove 50, and the oil conduit 51.

An $O_2$ sensor 91 is fitted upstream of a catalytic converter 90 in an exhaust passage of the engine, as shown in FIG. 7. This $O_2$ sensor 91 detects the concentration of oxygen in the exhaust gas, and outputs a signal corresponding thereto to a control unit 92.

The amount of fuel injected through the injectors 6 is proportional to the actual time period for fuel injection through the injectors 6, except during slow engine operation. Further, the basic value for the actual fuel injection period is proportional to the intake air volume of the engine. This intake air volume is measured by an air flow meter 94 which is provided in the intake passage 80 of the engine upstream of the throttle valve 81, and which outputs a signal representative thereof to the control unit 92. Further, a rotational speed sensor 95 detects the rotational speed of the engine, and outputs a signal representative thereof to the control unit 92.

This control unit 92 obtains a basic fuel injection time period for a single stroke cycle of the engine from the intake air volume and the engine rotational speed, applies various corrections to this basic time period, and then outputs pulse signals corresponding to the result to the fuel injectors 6; and these fuel injectors 6 then inject mounts of fuel corresponding to these pulse signals.

Further, the control unit 92 also controls the air/fuel ratio of the air-fuel mixture which is being supplied to this engine to be close to the stoichiometric value by performing feedback correction based upon the oxygen concentration which is detected by the $O_2$ sensor 91. Moreover, when this correction mount satisfies certain fixed conditions which are set in advance, a warning lamp 93 is illuminated, so as to warn the operator of the engine that fuel is leaking from the oil seal 70.

The fuel injection pump 4 supplies a sufficient volume of fuel for injection by the injectors 6 by pressurizing fuel according to the expansion and contraction of the three bellows 26. And this mount is set in advance so that, even if one of the three bellows 26 has become damaged, the expansion and contraction of the remaining two of the bellows 26 can provide a sufficient of fuel amount for injection by all of the injectors 6, except in the operational region in which the intake air volume is close to the maximum value.

When one of the bellows 26 becomes damaged, and fuel on the inside of this bellows 26 leaks out into the inside of the casing 13, then the pressure inside the casing 13 becomes close to the output pressure of the feed pump 3. As a result, fuel which has leaked out from the oil seal 70 flows via the escape conduit 73 into the intake passage 80. The fuel pressure in the space defined by the oil seals 70 and 71 is kept low by the fuel flowing out into the intake passage 80 via the escape conduit 73. Due to this, fuel pressure hardly acts at all upon the oil seal 71, and there is no danger of the fuel escaping to the outside of the casing 13.

It is also possible to connect together the casing 13 and the fuel tank 1, so that the fuel which leaked out from the damaged bellows 26 might be directly returned into the fuel tank 1. In this case, however, the output pressure of the feed pump 3 would drop because the large volume of fuel discharged by the feed pump 3 is recirculated to the fuel tank 1. This would lower the input pressure of the fuel injection pump 4, and this would exert an undesirable influence upon the output pressure and the flow amount from the other bellows 26 which were not damaged is thereby reduced.

As previously mentioned, the amount of fuel which is supplied to the injectors 6 for injection does not become insufficient even if one of the bellows 26 is damaged, provided that the aforesaid operational region for the intake air volume is not attained. Out of this region, therefore, the air/fuel ratio of the air-fuel mixture which is supplied to the engine becomes rich, due to the fuel which has flowed through the escape conduit 73 into the intake passage 80.

Although the flowrate of fuel which flows through the escape conduit 73 into the intake passage 80 is influenced by the intake vacuum, it is not influenced by the flowrate in the intake passage 80. In other words, the amount of fuel which flows through the escape conduit 73 into the intake passage 80 is almost constant irrespective of the intake air flowrate and as a result, the smaller is the intake air flowrate, the greater is the influence which the inflow of fuel from the escape conduit 73 exerts upon the air/fuel ratio.

Figure 9:
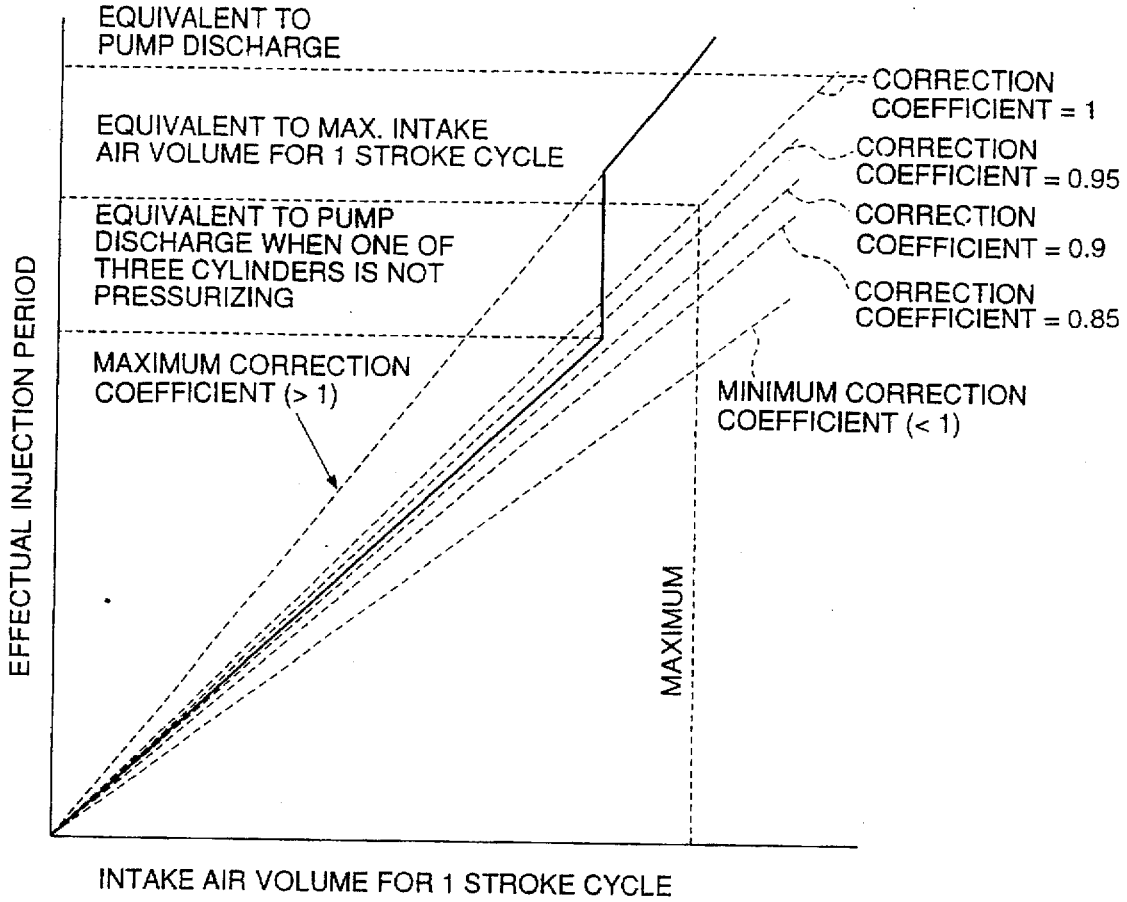
FIG. 9 is a graph showing a variation of a fuel injection period when leakage occurs in the fuel pump.

The time period for injection of fuel by the fuel injectors 6 which corresponds to the intake air volume for one stroke cycle of the engine is corrected by a feedback correction coefficient as shown in FIG. 9. In this figure, various values for the correction coefficient are represented by the slopes of the straight lines. Normally the correction coefficient is less than unity, and, the smaller is the intake air volume per one stroke cycle, the smaller is the correction coefficient. And the correction coefficient approaches unity as the intake air volume per one stroke cycle increases. Furthermore, when the intake air volume per one stroke cycle enters a region near its maximum value, it becomes impossible for the required amount of injected fuel to be provided by the expansion and contraction of only two of the three bellows 26. When one of the bellows 26 is damaged, the correction coefficient rises abruptly in this region and become greater than unity.

Figure 10:
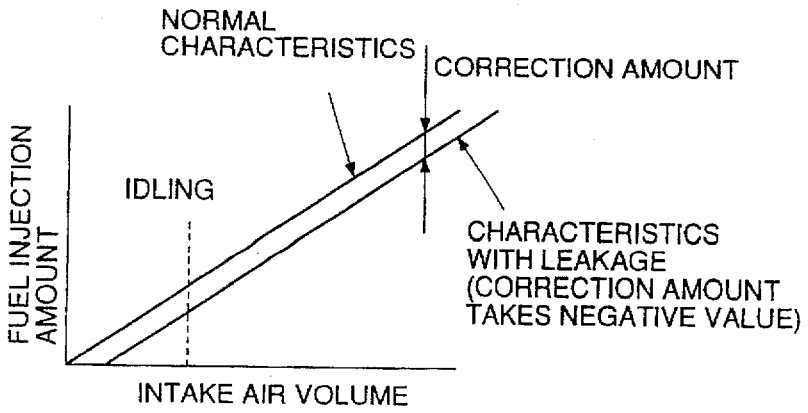
FIG. 10 is a graph for explanation of the difference in fuel injection amount per unit time between proper operation and when leakage is occurring.

On the other hand, as shown in FIG. 10, the flowrate of fuel which flows into the intake passage 80 from the escape conduit 73 is almost constant with relation to increase of the fuel injection period, i.e. increase of the amount of injected fuel, which is proportional to the intake air volume. In other words, the amount of fuel which flows into the intake passage 80 from the escape conduit 73 during one stroke cycle of the engine is inversely proportional to the rotational speed of the engine, and the greater the engine rotational speed becomes, i.e., the greater the amount of intake air per unit time period becomes, the less is the influence which this inflow amount of fuel from the escape conduit 73 exerts upon the air/fuel ratio, and the closer does the correction coefficient approach to unity.

Figure 11:
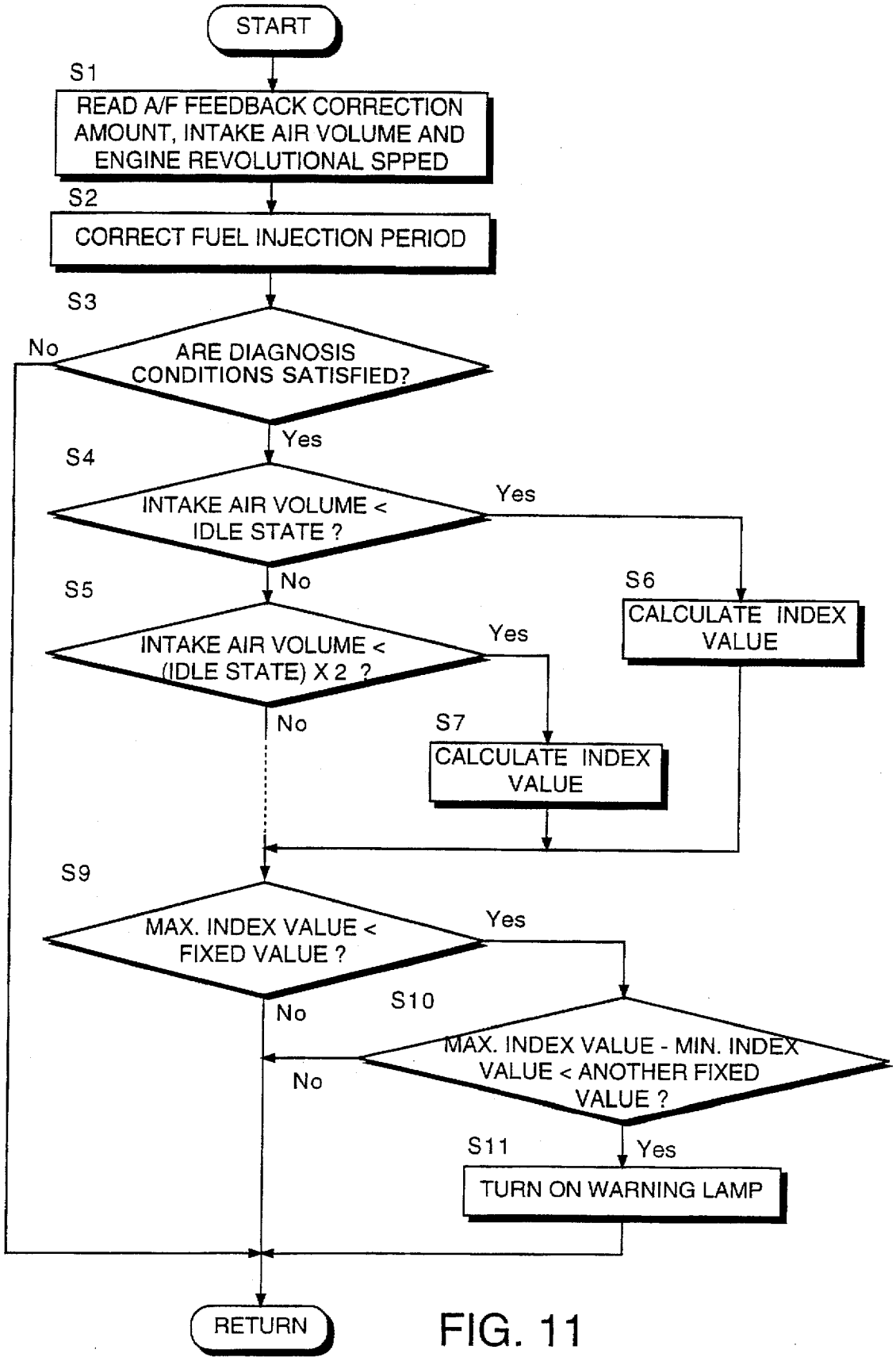
FIG. 11 is a flow chart for explanation of a diagnostic process for fuel injection leakage according to the first preferred embodiment of this invention.

The flow chart in FIG. 11 shows a routine which is executed by the control unit 92 to take advantage of the above described characteristic behavior, in order to detect the fuel leakage from the fuel injection pump 4. This process is performed just after the process of feedback correction calculation for the air/fuel ratio simultaneously with the injection of fuel by the fuel injectors 6. Since the feedback correction for the air/fuel ratio based upon the output of the $O_2$ sensor 91 is per se known, its explanation will be omitted from this flow chart. Moreover, this process of detection of fuel leakage is only executed when feedback correction of the air/fuel ratio towards the lean side has been performed.

In a step S1, a correction mount for feedback correction of the air/fuel ratio which has been calculated based upon the output of the $O_2$ sensor 91, an intake air volume per unit time which has been detected by the air flow meter 94, and an engine rotational speed which has been detected by the rotational speed sensor 95 are read in. Moreover, if this feedback correction amount has been calculated as a correction coefficient, a routine is first executed in order to convert it into a correction amount.

In a step S2, the time period for fuel injection by the injectors 6 is corrected based upon this correction amount.

In a step S3, a decision is made as to whether or not the current operational conditions of the engine are suitable ones for performing diagnosis of fuel leakage from the fuel injection pump 4. In other words, if at the current time either the intake air volume to the engine per one stroke cycle is greater than a predetermined value, or the engine is operating in the fuel cut off state, or purging is being performed in which evaporated fuel from the fuel tank is being supplied to the engine, then it is deemed that the current circumstances are not suitable for fuel leakage diagnosis, and the flow of control of this routine terminates. Since this routine diagnoses the leakage of fuel by detecting enrichment of the air/fuel ratio due to inflow of fuel to the intake passage 80 via the escape conduit 73, conditions like the above which bring about a large variation of air/fuel ratio are considered as being unsuitable for fuel leakage diagnosis, which is accordingly prevented.

If the current engine operational conditions are deemed as being suitable for fuel leakage diagnosis, then the flow of control is separated according to which of six operational regions the current operational conditions of the engine fall within: a first region in which the intake air volume per unit time is less than a threshold value which corresponds to the engine idling condition, a second region in which the intake air volume per unit time is less than twice this threshold intake air volume, and a third region in which the intake air volume per unit time is less than three times this threshold intake air volume. Similarly, a fourth to sixth regions are set depending on the intake air volume per unit time. However, in FIG. 11, only the steps S4 and S5 that correspond to the separation of the first region and second region respectively are shown. The other steps corresponding to the separation of the third to sixth regions and the related calculations as described hereintofore are represented by the dotted lines in the flowchart.

After the separation of the operational regions, for each of these operational regions respectively, the correction amount per unit time is calculated by sampling the feedback correction amount for the fuel injection time period and by multiplying it by the engine rotational speed. And weighted averaging is performed by taking, for example, the weighting coefficient for the previous value to be 7 and the weighting coefficient for the presently calculated value to be 1, and a index value for the feedback correction amount is calculated and is stored. This process is represented in the flowchart by steps S6 and S7 for example.

In this embodiment the number of the operational regions is set to six, but it should be noted that any other number greater or smaller than six can be applied as the number of operational regions.

In a step S9, the maximum one of the six correction coefficient index values for the various operational regions described above is compared with a fixed value which is determined in advance, and if this maximum index value is greater than the predetermined value then this routine terminates at this time point. On the other hand, if this maximum index value is less than the predetermined value, then in a step S10 the difference between this maximum index value and the minimum index value is compared with another fixed value which is determined in advance. And the occurrence of fuel leakage past the seal is diagnosed if and only if this difference is less than the fixed value, in which case in a step S11 the warning lamp 93 is illuminated. The correction amount for the air/fuel ratio when fuel is flowing through the escape conduit 73 into the intake passage 80 is almost constant without any dependence upon the intake air volume per unit time, as shown in the graph of FIG. 10, and in the steps S9 and S10 it is checked whether or not the actual correction amount for the air/fuel ratio follows this pattern, so as to determine whether or not fuel leakage is actually occurring. For example, since the pattern of air/fuel ratio correction when a particular one of the fuel injectors 6 has suffered a breakdown and has become unable to perform fuel injection is completely different from the one described above, accordingly by the operation performed in the steps S9 and S10 it is possible to exclude patterns of breakdown other than the one described above which is caused by leakage of fuel.

Further, according to this diagnostic method for detecting the inflow of fuel to the intake passage 80 from the escape conduit 73, leakage detection is possible even if for example a pinhole has appeared in one of the bellows 26.

Figure 12:
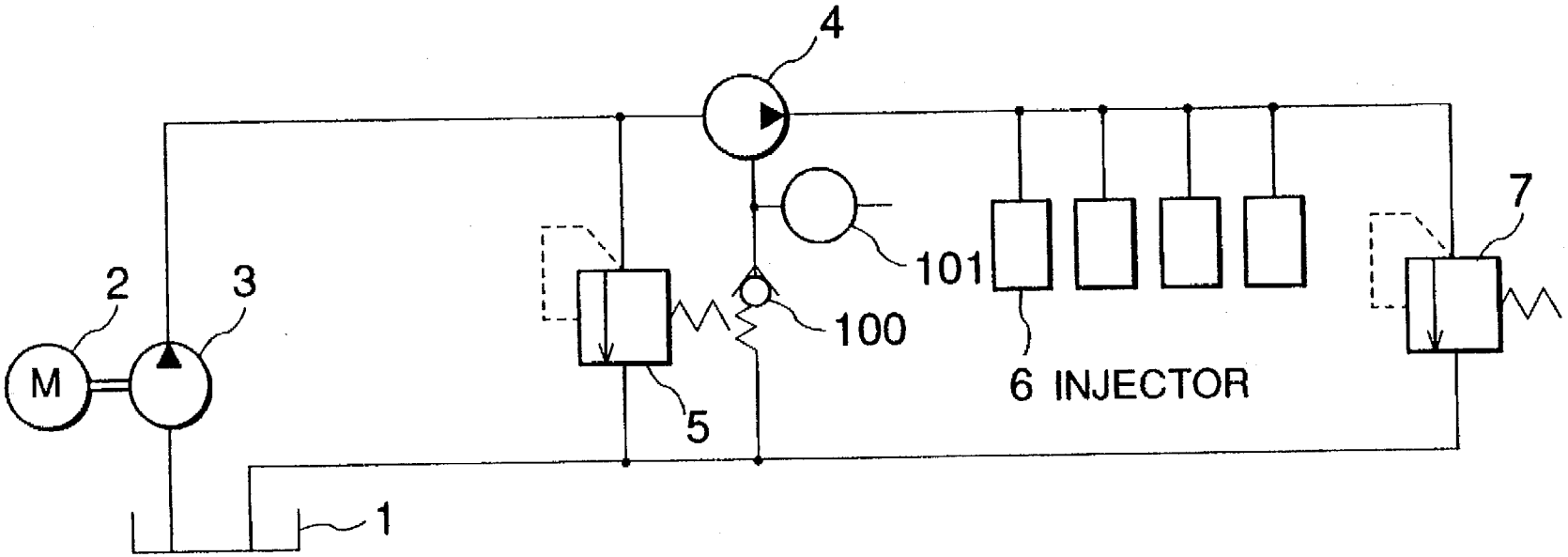
FIG. 12 is a schematic diagram showing a fuel injection system according to another preferred embodiment of this invention.

FIG. 12 shows another preferred embodiment of this invention.

The difference from the embodiment which was shown in FIG. 7 is that, instead of the escape conduit 73, an escape conduit 74 is provided which communicates to the fuel tank 1, and a pressure switch 101 and a check valve 100 are provided midway along this escape conduit 74. The operating pressure of the pressure switch 101 is set to be lower than the opening pressure for the check valve 100. It is difficult to detect the different of pressure upstream and downstream of the check valve 100 because the amount of flow along the escape conduit 74 due to leakage of fuel is minute. Therefore the fuel flow in the escape conduit 74 is detected by the provision of the pressure switch 101 which operates in this manner at a predetermined low pressure. According to this embodiment, the leakage of fuel is directly detected without any reliance upon the $O_2$ sensor 91 or the control unit 92 of the first preferred embodiment described above.

Figure 13:
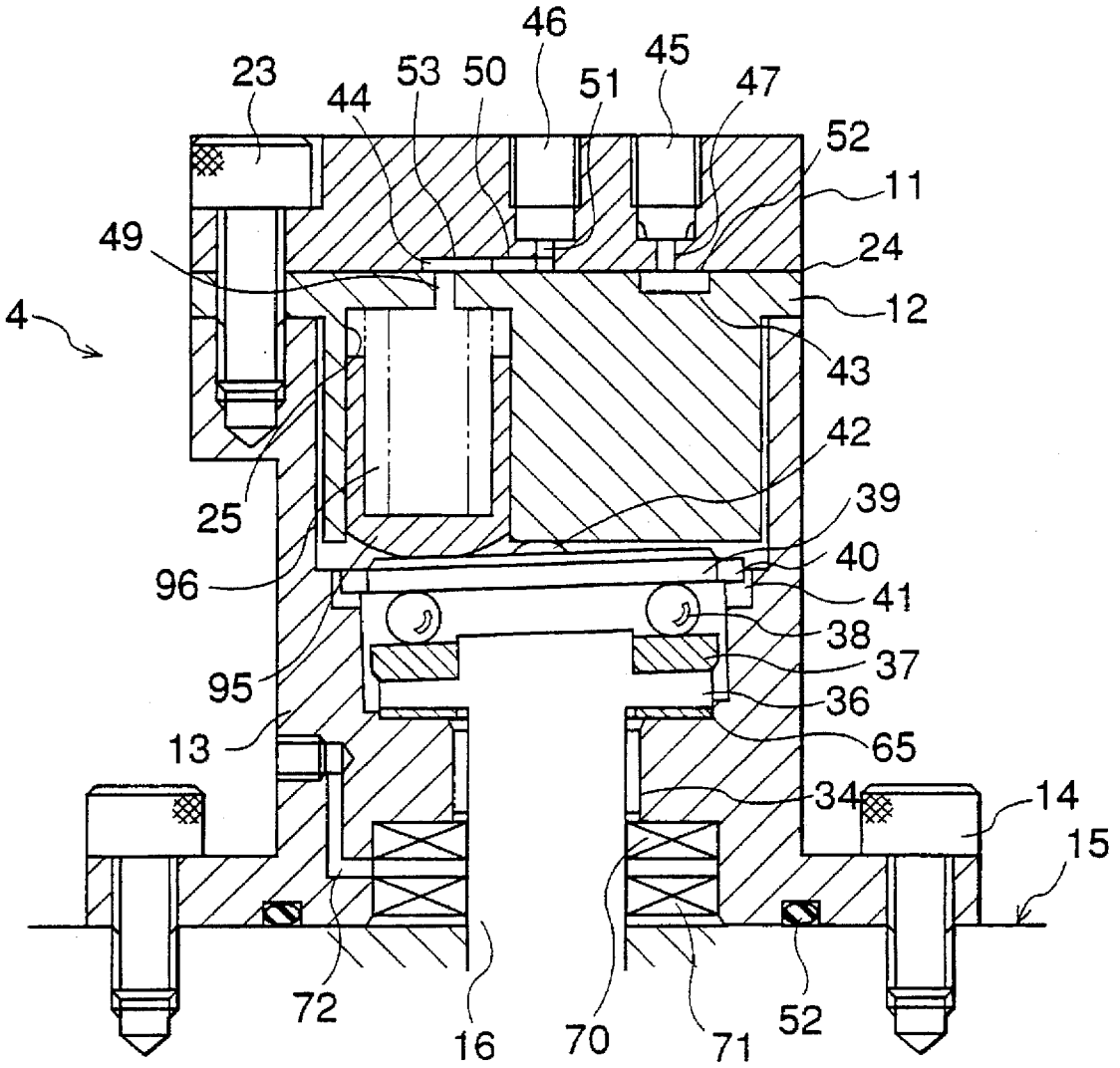
FIG. 13 is a longitudinal view of a fuel pump according to yet another preferred embodiment of this invention.

FIG. 13 shows another preferred embodiment of this invention relating to a fuel injection pump.

In this preferred embodiment, a plunger 95 is used instead of the bellows 26 of the fuel injection pump shown in FIG. 1. The plunger 95 is maintained in contact with the swashplate 39 by a spring 96.

In this preferred embodiment, although a high sealing quality is required from the oil seal 70, leakage of fuel to the outside of the pump is sufficiently prevented in the same manner as with the other preferred embodiments described above. Furthermore, by arranging the construction so that a warning is issued at the time point that leakage of fuel greater than a predetermined amount has occurred, it is possible to recognize abnormality before fuel has leaked out from the outer oil seal 71, in the same manner as with the two preferred embodiments described above.

The embodiments of this invention in which an exclusive property or privilege is claimed are defined as follows:

1. A fuel pump for supplying pressurized fuel to an engine, comprising:

a casing:

a pump chamber defined inside said casing:

a power input shaft which penetrates from the outside of said casing into the inside of said casing;

a means for expanding and contracting said pump chamber according to the rotation of said power input shaft;

a first seal member which is provided between said casing and said power input shaft;

a second seal member which is provided in series with said first seal member between said casing and said power input shaft; and a drain conduit which drains fuel which has leaked into a space defined between said first seal member and said second seal member, wherein said engine comprises an intake port for aspirating air and said drain conduit communicates with said intake port.

2. A fuel pump as defined in claim 1, further comprising means for detecting fuel flow in said drain conduit and means for emitting a warning when fuel is flowing in said drain conduit.

3. A fuel pump as defined in claim 2, wherein said engine further comprises an exhaust conduit for expelling exhaust, an $O_2$ sensor displaced in said exhaust conduit and providing an output signal corresponding to concentration of $O_2$ in said exhaust conduit, and means for feedback controlling an air/fuel ratio of an air-fuel mixture provided to said engine to a target value based upon a feedback control amount determined using the output signal of said $O_2$ sensor, and said means for detecting fuel flow in said drain conduit uses said feedback control amount for detecting fuel flow in said drain.

4. A fuel pump for supplying pressurized fuel to an engine, comprising:

a casing:

a pump chamber defined inside said casing:

a power input shaft which penetrates from the outside of said casing into the inside of said casing;

a means for expanding and contracting said pump chamber according to the rotation of said power input shaft;

a first seal member which is provided between said casing and said power input shaft;

a second seal member which is provided in series with said first seal member between said casing and said power input shaft;

a drain conduit which drains fuel which has leaked into a space defined between said first seal member and said second seal member;

a check valve provided part way along said drain conduit which is opened when subjected to a predetermined opening pressure;

a pressure switch provided upstream of said check valve in said drain conduit which turns on when subjected to a pressure lower than said opening pressure;

means for detecting fuel flow in said drain conduit based upon the turning on of said pressure switch; and means for emitting a warning when fuel is flowing in said drain conduit, wherein said engine comprises a fuel tank in which fuel is stored and said drain conduit communicates to said fuel tank.

* * * * *